US006021716A

United States Patent [19]

Taylor

[11] Patent Number: 6,021,716

[45] **Date of Patent: *Feb. 8, 2000**

[54] PENETRATOR HAVING MULTIPLE IMPACT SEGMENTS

[75] Inventor: Robert Joseph Taylor, Arlington, Tex.

[73] Assignee: Lockheed Martin Corporation, Bethesda, Md.

[ * ] Notice: This patent is subject to a terminal disclaimer.

[21] Appl. No.: 08/896,432

[22] Filed: Jul. 18, 1997

[51] Int. Cl.[7] ..... F42B 12/04

[52] U.S. Cl. ..... 102/517; 102/378; 102/388; 244/3.28; 244/3.3

[58] Field of Search ..... 102/357, 377, 102/378, 388, 393, 394, 439, 473, 478, 489, 501, 504, 506, 517–519, 521; 244/3.24–3.3

[56] References Cited

U.S. PATENT DOCUMENTS

| | | | |
|---|---|---|---|
| H905 | 4/1991 | Rottenberg | 244/3.28 |
| 395,881 | 1/1889 | Cunningham . | |
| 2,804,823 | 9/1957 | Jablansky . | |
| 2,945,442 | 7/1960 | Adelman et al. | 244/3.28 |
| 3,838,644 | 10/1974 | Prochnow et al. | 102/56 |
| 4,492,166 | 1/1985 | Purcell | 244/3.22 |
| 4,516,502 | 5/1985 | Klein et al. | 102/489 |
| 4,565,340 | 1/1986 | Bains | 244/3.28 |
| 4,635,556 | 1/1987 | Boecker et al. | 102/518 |
| 4,708,064 | 11/1987 | Bisping et al. | 102/517 |
| 4,716,834 | 1/1988 | Wallow et al. | 102/519 |
| 4,860,660 | 8/1989 | Synofzik et al. | 102/501 |
| 4,901,645 | 2/1990 | Bisping et al. | 102/521 |
| 4,907,512 | 3/1990 | Arene | 102/476 |
| 5,003,886 | 4/1991 | Pahnke et al. | 102/521 |
| 5,088,416 | 2/1992 | Sabranski | 102/517 |
| 5,526,752 | 6/1996 | Dahl et al. | 102/517 |

FOREIGN PATENT DOCUMENTS

| | | | |
|---|---|---|---|
| 493294 | 8/1919 | France | 102/478 |
| 2535450 | 5/1984 | France | 102/517 |
| 1231139 | 12/1966 | Germany | 244/3.28 |
| 3834925 | 4/1990 | Germany | 102/438 |
| 4007810 | 9/1991 | Germany | 102/517 |
| 4031208 | 4/1992 | Germany . | |

OTHER PUBLICATIONS

U.S. Pending Patent Application Serial No. 08/699,225.

*Primary Examiner*—Harold J. Tudor
*Attorney, Agent, or Firm*—Sidley & Austin

[57] ABSTRACT

A penetrator having a plurality of stacked penetrator segments is disclosed. Each penetrator segment has a nose portion and a rear portion. The rear portion of each penetrator segment has a rearwardly opening cavity therein and a plurality of fins pivotally mounted thereon. The penetrator segments are stacked such that the cavity of the forwardmost penetrator segment secureably contains the nose portion of the following penetrator segment such that there is a press-fit between the cavity and the nose portion. The following penetrator segments are similarly positioned such that the nose portion of each following penetrator segment is secureably positioned in the cavity of the immediately preceding penetrator segment. The fins of each penetrator segment are restrained in a stowed position when the cavity of the respective penetrator segment contains the nose portion of a following penetrator segment. An explosive element is located between each of the penetrator segments. Upon initiation of deployment of the penetrator, the segments remain in axial alignment until the explosive elements explode, thereby causing the penetrator segments to separate from each other. When a penetrator segment separates from a preceding segment, the fins of the preceding segment are allowed to pivot to their deployed positions. Once the fins of each penetrator segment have pivoted to their deployed positions, the penetrator is then in a fully deployed configuration such that each penetrator segment can separately impact a target.

32 Claims, 2 Drawing Sheets

PENETRATOR HAVING MULTIPLE IMPACT SEGMENTS

TECHNICAL FIELD OF THE INVENTION

The present invention relates to a projectile weapon for penetrating targets, and more particularly to a penetrator having a plurality of penetrator segments that are held in an undeployed configuration by a press-fit between segments, and that explosively separate during deployment of the penetrator and then sequentially impact a target.

BACKGROUND OF THE INVENTION

It is desirable to have a weapon that can destroy a variety of targets. For example, targets such as command and control centers are often buried underground and hardened with reinforced concrete overburdens. Heavily armored targets such as heavy tanks may be protected by multiple layers of hard armor, the defeat of which requires substantial penetration capability focused on a single impact point on the target. The defeat of other targets such as light armored vehicles and unarmored trucks can be enhanced by multiple impacts in different locations on the target.

One type of weapon that can be used to penetrate and destroy these kinds of targets is a projectile which impacts and penetrates a target by virtue of its kinetic energy, rather than by explosive energy. However, when such a projectile consists of only a single penetrator element, substantial stresses may be applied to the projectile by initial contact with the target or by certain features of the armor protection, and the impact may result in the breakup of the projectile with very little damage to the target. In addition, when a penetrator is employed at hyper velocity, a single large impacting element is not as effective in penetration of heavy armor as the same mass divided into a plurality of impact segments that each impact the target in the same location.

Thus, improved penetration can be achieved by a projectile having multiple penetrator segments that sequentially impact the target. One such penetrator has multiple non-aerodynamically stable segments, each having a nose portion and a rearwardly opening cavity. The segments are stacked such that the nose portion of a segment is positioned in the cavity of an immediately preceding segment. The segments are separated during flight by initiation of a time-to-go fuze. U.S. Pat. No. 5,088,416 discloses a projectile having multiple impact bodies positioned sequentially along a central rod which holds the impact bodies in initial axial alignment. After a predetermined flight time, the impact bodies are released and biased apart by springs or dished washers so that the impact bodies spread apart along the rod. The impact bodies then successively impact the target so that each impact body independently attacks the target with its full kinetic energy.

Similarly, U.S. Pat. No. 4,716,834 discloses a projectile having a pre-penetrator and a main penetrator. The pre-penetrator contains a plurality of stacked cylindrical cores in axial alignment with each other. Centering and/or fixing means between the cores include a weakened portion so as to achieve a fracturing or separation upon the application of a predetermined load. When the projectile impacts a target, the leading core in the stack impacts the target and disintegrates, followed by the impact of the next core in the stack, and so on until all the cores have successively impacted the target. U.S. Pat. No. 4,708,064 discloses a similar projectile having a plurality of stacked cores contained within the projectile. The cores are intermitted and connected together by centering and/or fixing means which break upon impact, such as a thin-walled and comparatively soft casing or easily rupturable pins, which hold the cores in alignment until impact. When the projectile impacts a target, each core sequentially impacts the target in the same location while the centering and/or fixing means tear away from the impact so as not to adversely interfere with the impact of each core. U.S. Pat. No. 4,635,556 discloses a penetrator that has a stack of interfitted core elements having partially convex front faces and complementary partially concave rear faces, and which are contained within a casing. A main penetrator body interfits with the rearmost core element and a tip at the front of the forwardmost core elements presses the core elements toward the main penetrator body. The core elements form radially outwardly open annular grooves at the faces which allow the penetrator to break apart at these grooves. Upon reaching the target, each core element sequentially impacts the target.

Other kinds of multistage penetrators include the projectile disclosed by U.S. Pat. No. 5,526,752, which contains multiple warheads mounted in tandem within the casing of the projectile. Upon reaching a target, a fuzing mechanism located at the front of the casing causes the warheads to detonate sequentially, starting with the rearmost warhead to the frontmost warhead. U.S. Pat. No. 4,901,645 discloses a projectile having a single penetrator rod that has a plurality of annular grooves. Upon impact, the rod breaks along the grooves, allowing the rod to separate into sections that then separately impact the target in the same location.

One disadvantage of the above described penetrators is that the effectiveness and location of the impact of each impact body, core, warhead or rod section (all referred to as penetrator segments) depends on the impact of the preceding penetrator segment. Because the segments of these penetrators are held closely together up to the point of impact, either by a central rod or by containment within the penetrator, each segment will impact the same location on the target almost immediately after the impact of the preceding segment. If the preceding segment does not fully disintegrate immediately upon impact, then the impact of the next segment will be disrupted by the debris and remnants from the preceding impact. A greater distance between the segments, thereby allowing for a greater amount of time between impacts, would allow each segment to impact the target after the preceding segment has fully disintegrated and the gases and/or remnants of the preceding impact have been exhausted. The above described penetrators do not allow for a significant distance between the segments due to size constraints of the projectile, both for storage and deployment purposes.

Furthermore, because each of the segments in these penetrators is held in axial alignment until impact, these penetrators are constrained to impacting a target at a single location. While sequential impact in a single location can be desirable for penetrating buried and/or multilayered targets, other targets may be more suitably defeated by multiple impacts in several locations. The above described projectiles cannot impact a target at multiple locations, even though the penetrators contain multiple impact segments.

The inventor of the invention claimed herein has previously filed a U.S. patent application, Ser. No. 08/699,225, entitled "Penetrator Having Multiple Impact Segments" now U.S. Pat No. 5,384,684, that is suitable for solving the above listed problems. Application Ser. No. 08/699,225 discloses a penetrator comprised of a plurality of stacked penetrator segments, including a leading penetrator segment, at least one intermediate penetrator segment, and a trailing penetrator segment, all sequentially positioned along the longitudinal axis of the penetrator. Each penetrator segment has a nose portion and a rear portion. The rear portion of the leading penetrator segment and of each intermediate penetrator segment has a plurality of fins pivotally mounted thereon and a rearwardly opening cavity. The rear portion of the trailing penetrator segment has an enlarged tail. The penetrator segments are stacked along the longitudinal axis of the penetrator such that the rearwardly opening cavity of the leading penetrator segment contains the nose portion of the forwardmost intermediate penetrator segment. Each intermediate penetrator segment is stacked with its nose portion positioned within the rearwardly opening cavity of the immediately preceding penetrator segment. The penetrator segments are further stacked such that the nose portion of the trailing penetrator segment is positioned within the rearwardly opening cavity of the rearmost intermediate penetrator segment.

Each fin on the penetrator segments has a stabilizing portion and a deployment preventing arm. The deployment preventing arm contacts the nose portion of the immediately following penetrator segment when that nose portion is fully inserted into the respective rearwardly opening cavity. The contact between the nose portion and the deployment preventing arm of each fin prevents the fins from pivoting to their deployed positions and causes the fins to be restrained in their stowed positions. When the nose portion withdraws from the rearwardly opening cavity, the contact between the nose portion and the arm of each fin is discontinued, thereby permitting the fins of the penetrator segment to pivot to their deployed positions.

Upon launching the penetrator, aerodynamic drag against the enlarged tail of the trailing penetrator segment causes the velocity of the trailing penetrator segment to decrease with respect to the remaining stacked penetrator segments. The nose portion of the trailing penetrator segment thereby withdraws from the rearwardly opening cavity of the rearmost intermediate penetrator segment and the trailing penetrator segment thus separates from the remaining stacked penetrator segments. The withdrawal of the nose portion of the trailing penetrator segment from the rearwardly opening cavity of the rearmost intermediate penetrator segment permits the fins of the rearmost positioned intermediate penetrator segment to deploy. The stabilizing portions of the deployed fins of the rearmost intermediate penetrator segment encounter aerodynamic drag, thus decreasing the velocity of the rearmost intermediate penetrator segment. The nose portion of the rearmost intermediate penetrator segment thereby withdraws from the rearwardly opening cavity of the immediately preceding penetrator segment, which thus permits the fins of the immediately preceding penetrator segment to deploy. The fins of each of the at least one intermediate penetrator segment are similarly allowed to deploy, until the forwardmost intermediate penetrator segment separates from the leading penetrator segment. Thereupon, the penetrator has fully separated into discrete penetrator segments which are aerodynamically stabilized and which can sequentially impact a target. By initiating separation of the penetrator segments at an appropriately short distance from the target, the separated penetrator segments can then impact the target in a collinear manner so that each penetrator segment impacts the target in the same location. Alternatively, by initiating separation of the penetrator segments at a sufficiently long distance from the target, the penetrator segments will disperse due to aerodynamic asymmetries, thereby causing the penetrator segments to impact the target in multiple locations.

This penetrator can be improved upon by increasing the stability of the penetrator in its undeployed state. The preferred embodiment of the penetrator described in application serial number 08/699,225 shows segments having conical shaped noses that fit within conical shaped cavities of the rear portions of the segments. The conical shape of the noses and cavities allows for only limited stability of the overall penetrator in its undeployed configuration. The stability can be enhanced by the use of a central connecting rod or wire running along the longitudinal axis of the segments, but the rod or wire, can interfere with the penetrator both during flight and upon impact. If the center rod or wire is eliminated, the segments will begin to separate immediately upon deployment of the penetrator, which does not allow for controlled timing of the separation of the segments. Moreover, because upon deployment, the segments aerodynamically separate from the rearmost segment forward, the rearmost segment may be excessively spaced apart from the preceding penetrator segments by the time the forwardmost penetrator segment is suitably spaced from the following penetrator segments. It is therefore desirable to control the spacing between the segments and the axial alignment of the segments to maximize the destructive capability of the penetrator. It is also desirable to have a multiple-segment penetrator that has enhanced stability in its undeployed configuration and which can separate during deployment such that the segment spacing can be controlled prior to impact with the target.

SUMMARY OF THE INVENTION

It is an object of the present invention to provide a penetrator capable of impacting a target a multiple number of times. It is a further object of the present invention to provide a penetrator that is capable of sequentially impacting the same location on a target a multiple number of times, or is capable of impacting multiple locations on the same target.

Another object of the present invention is to provide a penetrator capable of separating into multiple segments before impacting a target such that the distance between the separated segments is sufficient to prevent the impact of a preceding segment from adversely affecting the impact of a following segment. It is also an object of the present invention that the segments can simultaneously separate or sequentially separate during the flight of the penetrator, and that the segments can travel at a uniform separation and at a uniform velocity prior to impact. It is also an object of the invention that the segments be aerodynamically stable during flight.

Another object of the present invention is to provide a penetrator having a stiff flight body without the use of a central connecting rod or wire, but that can also separate into multiple spaced-apart segments during flight. It is a further object of the present invention to provide a penetrator having a smaller stored length than the fully deployed length upon initiating impact with a target.

The invention is a penetrator comprised of a plurality of stacked penetrator segments, including a leading penetrator segment, at least one intermediate penetrator segment, and a trailing penetrator segment, all sequentially positioned along the longitudinal axis of the penetrator. Each penetrator segment has a nose portion and a rear portion. The rear portion of the leading penetrator segment and of each intermediate penetrator segment has a plurality of fins pivotally mounted thereon and a rearwardly opening cavity. The rear portion of the trailing penetrator segment has an enlarged tail. The penetrator segments are stacked along the longitudinal axis of the penetrator such that the nose portion of the forwardmost intermediate penetrator segment is press-fit in the rearwardly opening cavity of the leading penetrator segment. Each intermediate penetrator segment is stacked with its nose portion press-fit within the rearwardly opening cavity of the immediately preceding penetrator segment. The penetrator segments are further stacked such that the nose portion of the trailing penetrator segment is press-fit within the rearwardly opening cavity of the rearmost intermediate penetrator segment. An explosive element is located between each penetrator segment to overcome the press-fit between the segments at a predetermined time after launch of the penetrator.

Each fin on the penetrator segments has a stabilizing portion and a deployment preventing arm. The deployment preventing arm contacts the nose portion of the immediately following penetrator segment when that nose portion is fully inserted into the respective rearwardly opening cavity. The contact between the nose portion and the deployment preventing arm of each fin prevents the fins from pivoting to their deployed positions and causes the fins to be restrained in their stowed positions. When the nose portion withdraws from the rearwardly opening cavity, the contact between the nose portion and the arm of each fin is discontinued, thereby permitting the fins of the penetrator segment to pivot to their deployed positions.

Upon launching the penetrator, the penetrator segments remain in axial alignment until a predetermined time after launch, whereupon the explosive elements between the penetrator segments explode, thereby causing the segments to separate from each other. Thereupon, the penetrator has fully separated into discrete penetrator segments which are aerodynamically stabilized and which can sequentially impact a target. By initiating separation of the penetrator segments at an appropriately short distance from the target, the separated penetrator segments can then impact the target in a collinear manner so that each penetrator segment impacts the target in the same location. Alternatively, by initiating separation of the penetrator segments at a sufficiently long distance from the target, the penetrator segments will disperse due to aerodynamic asymmetries, thereby causing the penetrator segments to impact the target in multiple locations.

DETAILED DESCRIPTION

Figure 1:
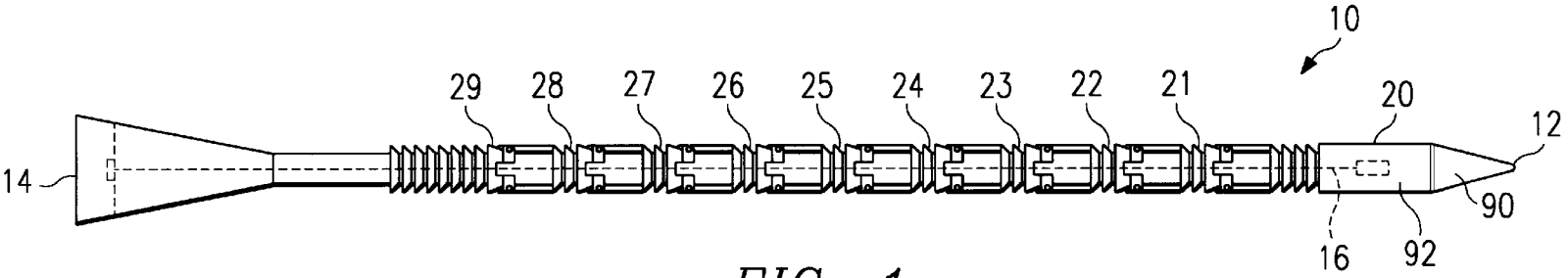
FIG. 1 is a side view of a penetrator according to the present invention, the penetrator having a plurality of stacked penetrator segments.

FIG. 1 shows a penetrator 10 having a leading end 12, a trailing end 14, and a longitudinal axis 16 extending between the ends 12 and 14. The penetrator 10 is comprised of a plurality of stacked penetrator segments 20–29, including a leading penetrator segment 20, eight intermediate penetrator segments 21–28, and a trailing penetrator segment 29.

Figure 2B:
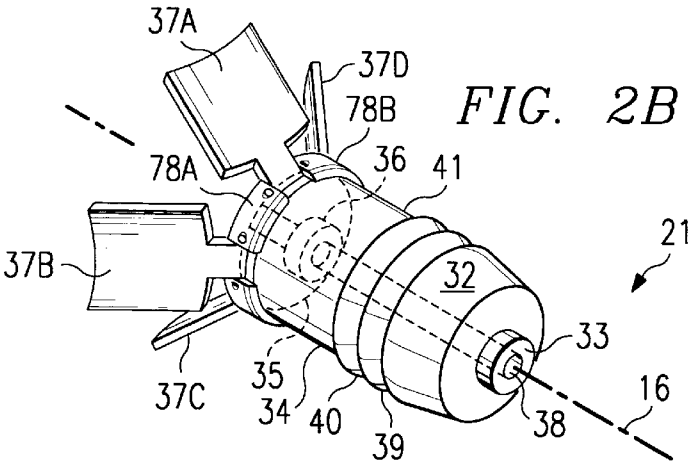
FIG. 2B is a perspective view of a penetrator segment having fins in a deployed position.
Figure 2A:
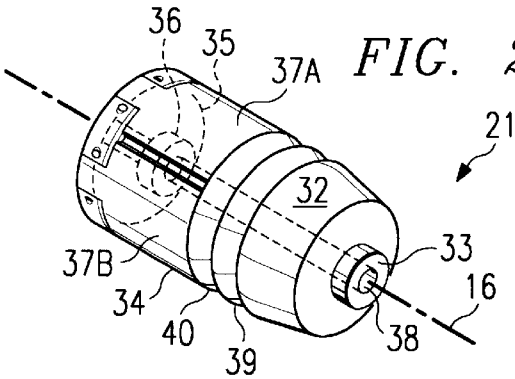
FIG. 2A is a perspective view of a penetrator segment having fins in a stowed position.

FIG. 2A shows a representative individual intermediate penetrator segment, for example, intermediate penetrator segment 21, in a stowed configuration. The intermediate penetrator segment 21 has a nose portion 32 and a rear portion 34. Preferably, the exterior surface of the nose portion 32 has a tapered, frustoconical shape. A protruding tip 33, having a smaller radius than nose portion 32, preferably extends forwardly from the nose portion 32. The rear portion 34 is preferably at least substantially in the shape of a right circular cylinder which is also coaxial with longitudinal axis 16. The rear portion 34 further has a rearwardly opening cavity 35 which is shown by a dashed line in FIG. 2A. The cavity 35 preferably has a tapered, frustoconical shape so as to be able to accommodate and to be complementary to the tapered, frustoconical shape of a nose portion of another penetrator segment. Cavity 35 furthermore preferably has a forwardly protruding indentation 36 that can accommodate the tip of a nose portion of a rearwardly positioned penetrator segment. The cavity 35 and indentation 36 are sized such that the nose and tip of a rearwardly positioned penetrator segment must be forced or press-fit into the cavity 35 and indentation 36. Each of four fins 37A–37D (only 37A and 37B being visible in FIG. 2A) is pivotally mounted to the rear portion 34 so that the fins extend forwardly therefrom when in their stowed positions. In their stowed positions, the fins 37A–37D are laid alongside the rear portion 34 of the penetrator segment 21 with the longitudinal axis of each fin being at least substantially parallel to the longitudinal axis 16. A cavity 38 extends along the longitudinal axis 16 of the penetrator segment 21, and extends from the tip 33 through the rear portion 34 of the segment 21. As will be discussed with respect to FIGS. 3 and 4, the cavity 38 can accommodate a pyrotechnic cord for facilitating separation of segments 20–29.

Optional grooves 39 and 40, located between the nose portion 32 and the rear portion 34, allow for the penetrator 10 to be encompassed by a sabot (not shown in these figures). A sabot can be used to facilitate the firing of the penetrator 10 from a launch tube, for example, by conforming the outer shape and size of the penetrator 10, including the sabot, to the shape and size of the launch tube. Upon firing the penetrator 10 from the launch tube, the sabot would break apart and fall away from the penetrator 10.

FIG. 2B shows the penetrator segment 21 with its fins 37A–37D in a deployed position. As can be seen in FIG. 2B with the fins in their deployed position, a section 41 of the rear portion 34 has a diameter that is sufficiently smaller than the maximum diameter of the nose portion 32 so that the section 41 of the rear portion 34 can accommodate the fins 37A–37D such that when they are in the stowed position they do not significantly protrude radially outwardly beyond the maximum diameter of the nose portion 32. The fins 37A–37D preferably have a curved shape so as to lay smoothly against the curved surface of section 41 of the rear portion 34.

Figure 3:
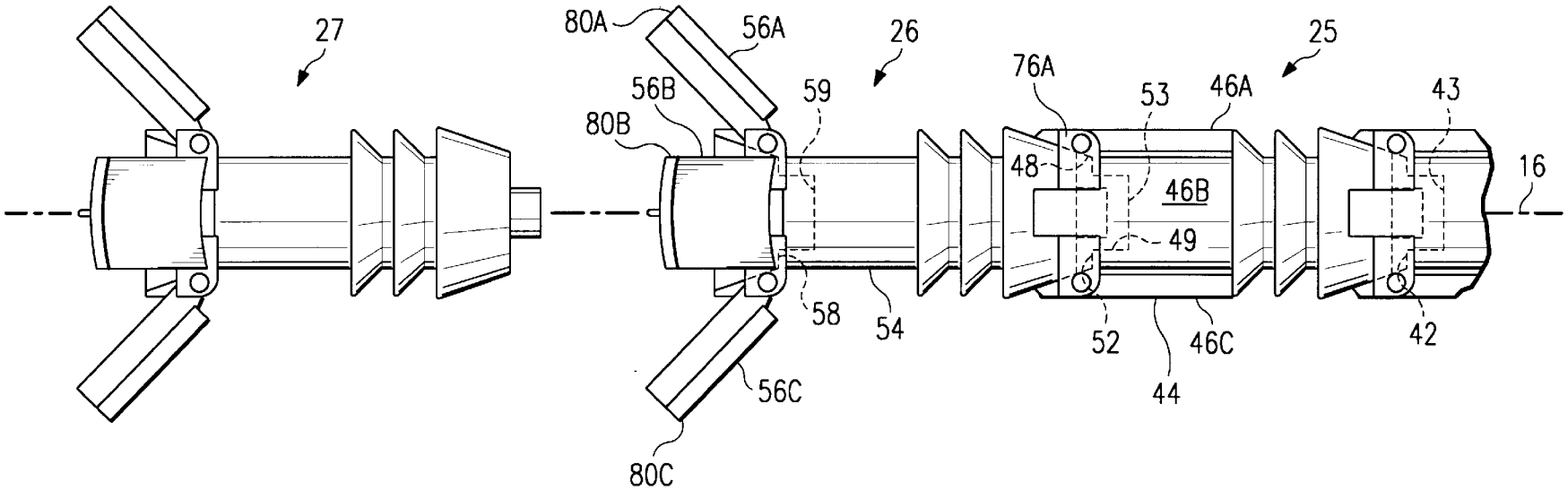
FIG. 3 is a side view of three penetrator segments in a partially deployed configuration.
Figure 4:
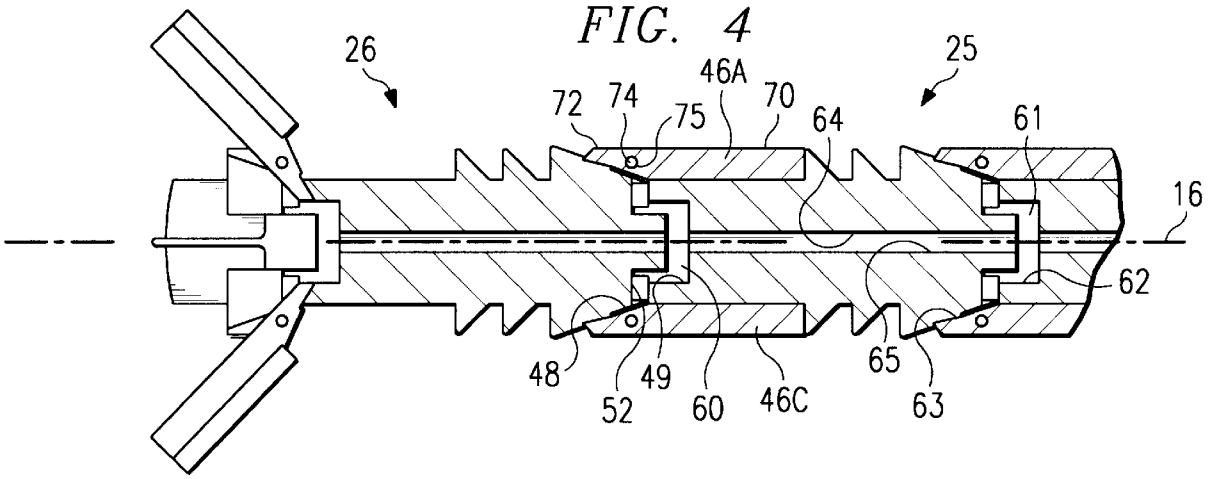
FIG. 4 is a cross-sectional view of two penetrator segments in a partially deployed configuration.

FIG. 3 shows an intermediate stage in the deployment of the penetrator 10 wherein two intermediate penetrator segments, for example intermediate penetrator segments 25 and 26, are still in the stacked configuration, and a third intermediate penetrator segment 27 has separated from the penetrator segment 26. Like penetrator segment 21 described in FIG. 2A, penetrator segment 25 has a nose portion 42 having a tip 43, a rear portion 44, fins 46A–46D (46D not visible) in the stowed position, and a rearwardly opening cavity 48 having an indentation 49. Similarly, the penetrator segment 26 has a nose portion 52 having a tip 53, a rear portion 54, fins 56A–56D (56D not visible) in the deployed position, and a rearwardly opening cavity 58 having an indentation 59. The nose portion 52 and tip 53 of the penetrator segment 26 are positioned within the cavity 48 and indentation 49, respectively, of the penetrator segment 25, so that the penetrator segments 25 and 26 are stacked in axial alignment. The nose portion 52 and tip 53 of penetrator segment 26 are press-fit (or force-fit) within the cavity 48 and indentation 49 respectively of penetrator segment 25 so that the segments 25 and 26 are secured together in the stacked configuration. When penetrator 10 is undeployed such that segments 20–29 are stacked, the press-fit between each segment greatly enhances the strength and stability of the penetrator 10. In order to overcome the press-fit so that the segments 20–29 can separate during flight, an explosive element is located between each segment. For example, as shown in FIG. 4, an explosive element 60 is contained in the indentation 49 of the rearwardly opening cavity 48 of the segment 25 and an explosive element 61 is contained in the indentation 62 of the rearwardly opening cavity 63 of the segment 24 (the segment 24 being only partially visible in the figure). Preferably, the explosive elements are connected by a pyrotechnic cord 64 contained within a central cavity 65, which extends along the longitudinal axis 16 of the penetrator from the leading segment 20 to the trailing segment 29. The portion of the cavity 65 extending through segment 21 is also shown by reference number 38 in FIGS. 2A and 2B. At a predetermined time after launch of the penetrator 10, the pyrotechnic cord 64 is activated, thereby initiating each explosive element, such as the explosive elements 60 and 61, which then causes the segments 20–29 to separate. Other suitable methods can be used for initiating the explosive elements. For example, each explosive element can have a separate electrical initiator or time-to-go fuze.

Each fin, for example fin 46A, has a stabilizing portion 70 and a deployment preventing arm 72 on opposite sides of a pivot pin 74. The pivot pin 74 runs through a pinhole 75 in the fin 46A and is mounted between two bosses 76A and 76B positioned on either side of the fin 46A (boss 76A is visible in FIG. 3; see also bosses 78A and 78B in FIG. 2B). Pivot pin 74 is preferably located in a plane which is perpendicular to the longitudinal axis 16. The stabilizing portion 70 and the deployment preventing arm 72 are positioned on opposite sides of pivot pin 74 around which the stabilizing portion 70 and the arm 72 can rotate. The deployment preventing arm 72 of the fin 46A is shown contacting the nose portion 52 of the intermediate penetrator segment 26. The contact of the arm 72 with the nose portion 52 prevents the fin 46A from pivoting in an outward direction; thus the fin 46A is restrained in a stowed position with the longitudinal axis of the fin 46A being substantially parallel to the longitudinal axis 16. When the nose portion 52 of penetrator segment 26 is positioned within the cavity 48 of the penetrator segment 25, arm 72 contacts the nose portion 52 of the penetrator segment 26, causing the fin 46A to remain forwardly pivoted about pivot pin 74, thereby restraining the fin 46A in a stowed position. In contrast, because the penetrator segment 27 shown in FIG. 3 is not positioned in the cavity 58 of the penetrator segment 26, the fins 56A–56D are free to pivot to their deployed positions wherein the longitudinal axis of each fin 56A–56D is at an angle to the longitudinal axis 16. When the fins 56A–56D are in their deployed positions, the stabilizing portions 80A–80D (80D not visible) of these fins 56A–56D facilitate the aerodynamic stability of the penetrator segment 26 during flight. While four fins have been illustrated for each penetrator segment, any suitable number of fins can be employed.

When the penetrator 10 is launched, the segments 20–29 remain in a stacked configuration due to the press-fit between segments, as shown in FIG. 1, until a predetermined time after launch, at which time the pyrotechnic cord 64 is activated. Thereupon, each explosive element is initiated so that the segments 20–29 separate. The explosive elements can be simultaneously initiated so that the segments simultaneously separate, or, the explosive elements may be initiated at varying times, for example, sequentially from the rearmost explosive element forward. If the explosive elements are initiated early in the flight of the penetrator 10 and at a suitably large distance from the intended target, then asymmetric aerodynamic forces acting upon the penetrator segments 20–29 after separation can cause the penetrator segments 20–29 to scatter so that the penetrator segments 20–29 impact the target in multiple locations. In contrast, if the explosive elements are initiated late in the flight of the penetrator and at a suitably close distance to an intended target, then the penetrator segments 20–29 will be substantially axially aligned upon impacting the target so that the penetrator segments 20–29 will sequentially impact the target in substantially the same location. Based on the drag of the preceding segments and the flight time to the target, the size of the stabilizing portions of the fins of each penetrator segment can be varied to control the spacing between the segments, for example, to achieve a uniform distance between the segments and a uniform velocity. Thus, when the penetrator 10 impacts an intended target, the penetrator segments 20–29 are separated from each other, and the distance between the penetrator segments 20–29 (the amount of separation between immediately adjacent penetrator segments) can be controlled. Once each segment has withdrawn from the preceding segment, the fins of the preceding segment are free to pivot to their deployed positions. The deployment of the fins is preferably accomplished by aerodynamic forces acting on the stabilizing portions of the fins after the segments have separated. Alternatively, deployment may be caused by a suitable mechanism such as by springs bearing the fins toward their deployed position.

While penetrator 10 is shown to have ten penetrator segments, the penetrator may have any suitable number of penetrator segments, with the potential for destroying a target increasing as more segments are used. The plurality of stacked penetrator segments 20–29 includes a leading penetrator segment 20 which preferably has slightly different characteristics than the intermediate penetrator segments 21–28 as described with respect to FIGS. 2A–B, 3 and 4. In particular, the leading penetrator segment 20 preferably has an elongated, tapered nose portion 90 without a protruding tip, such as tip 33, and that has a cylindrically shaped base 92.

Reasonable other variations and modifications of the above described penetrator are possible within the scope of the foregoing description, the drawings, and the appended claims to the invention.

What is claimed is:

1. A penetrator for impacting a target, said penetrator having a leading end, a trailing end, and a longitudinal axis extending between said leading end and said trailing end, said penetrator comprising:

a plurality of penetrator segments positioned in axial alignment with each other along the longitudinal axis of said penetrator to form a stack, each of said penetrator segments having a nose portion and a rear portion, said plurality of penetrator segments including a leading penetrator segment, at least one intermediate penetrator segment, and a trailing penetrator segment;

said leading penetrator segment being positioned at the leading end of said penetrator, the rear portion of said leading penetrator segment having a rearwardly opening cavity therein, the rearwardly opening cavity being shaped to secureably receive a nose portion of a forwardmost one of said at least one intermediate penetrator segment such that there is a press-fit between the rearwardly opening cavity of said leading penetrator segment and the nose portion of the forwardmost one of said at least one intermediate penetrator segments;

the rear portion of each of said at least one intermediate penetrator segment having a rearwardly opening cavity therein, the rearwardly opening cavity of each of said at least one intermediate penetrator segment being shaped to secureably receive a nose portion of an immediately rearwardly positioned penetrator segment such that there is a press-fit between the rearwardly opening cavity of each of said at least one intermediate penetrator segment and the nose portion of the respective immediately rearwardly positioned penetrator segment, the rear portion of each of said at least one intermediate penetrator segment having a plurality of fins pivotally mounted thereon, each of the fins having a stowed position and a deployed position, the nose portion of each of said at least one intermediate penetrator segment being positioned within the rearwardly opening cavity of an immediately preceding penetrator segment;

said trailing penetrator segment being positioned such that said at least one intermediate penetrator segment is located between said leading penetrator segment and said trailing penetrator segment, the nose portion of said trailing penetrator segment being positioned in the rearwardly opening cavity of a rearmost one of said at least one intermediate penetrator segment such that the nose portion of said trailing penetrator segment engages an element associated with each of said fins of the rearmost one of said at least one intermediate penetrator segment to thereby prevent the fins of the rearmost one of said at least one intermediate penetrator segment from pivoting from their stowed positions to their deployed positions; and a plurality of explosive elements, with at least one explosive element being positioned between each pair of adjacent penetrator segments when said plurality of penetrator segments are positioned in axial alignment with each other;

whereby upon initiation of deployment of said penetrator, said plurality of penetrator segments remain in axial alignment until said plurality of explosive elements explode, thereby causing each pair of adjacent penetrator segments to separate from each other; whereupon the fins of said at least one intermediate penetrator segment pivot from their stowed positions to their deployed positions; whereupon said penetrator segments have separated from each other and each penetrator segment is aerodynamically stable and can separately impact the target in sequence.

2. A penetrator in accordance with claim 1, wherein each of said fins has a stabilizing portion and a deployment preventing arm, said stabilizing portion and said deployment preventing arm being positioned about a pivot, such that when the nose portion of a rear penetrator segment of a pair of immediately adjacent penetrator segments is positioned in the rearwardly opening cavity of a front penetrator segment of the respective pair of immediately adjacent penetrator segments, the nose portion of the rear penetrator segment of the respective pair contacts the deployment preventing arms of the fins of the front penetrator segment of the respective pair so as to prevent the fins of the front penetrator segment of the respective pair from pivoting from their stowed positions to their deployed positions; and such that when the nose portion of the rear penetrator segment of the respective pair withdraws from the rearwardly opening cavity of the front penetrator segment of the respective pair, the nose portion of the rear penetrator segment of the respective pair disengages from contacting the deployment preventing arms of the fins of the front penetrator segment of the respective pair to pivot from their stowed positions to their deployed positions.

3. A penetrator in accordance with claim 1, wherein the nose portion of each of said at least one intermediate penetrator segment and of said trailing penetrator segment has a frustoconical portion and a tip portion having a smaller diameter than the minimum diameter of the frustoconical portion.

4. A penetrator in accordance with claim 3, wherein the rearwardly opening cavity of each of said at least one intermediate penetrator segment and of said leading penetrator segment has a frustoconical portion and an indentation having a smaller diameter than the minimum diameter of the frustoconical portion, so that the frustoconical portion and indentation of the rearwardly opening cavity are complementary to the frustoconical portion and tip portion respectively of the nose portion of the immediately rearwardly positioned penetrator segment.

5. A penetrator in accordance with claim 1, wherein said penetrator further comprises:

a pyrotechnic cord extending along the longitudinal axis of said penetrator and connecting said plurality of explosive elements;

whereby said plurality of penetrator segments are secured in axial alignment with each other in a stacked configuration until said pyrotechnic cord is activated, thereby initiating explosion of said plurality of explosive elements, and thereby causing said plurality of penetrator segments to separate from each other.

6. A penetrator in accordance with claim 5, wherein said plurality of explosive elements explode at a time after launching of said penetrator such that each of said plurality of penetrator segments can impact the target in substantially a single location on the target.

7. A penetrator in accordance with claim 5, wherein said plurality of explosive elements explode at a time after launching of said penetrator such that aerodynamic forces can cause said plurality of penetrator segments to impact the target in multiple locations on the target.

8. A penetrator in accordance with claim 1, wherein when the fins of said at least one intermediate penetrator segment are in their stowed positions, each fin of said at least one intermediate penetrator segment has an aerodynamic surface which is exposed to air flow, wherein air flow across the aerodynamic surfaces of the fins of said at least one intermediate penetrator segment subsequent to launching of said penetrator causes the fins of said at least one intermediate penetrator segment to open to their deployed positions.

9. A penetrator in accordance with claim 1, wherein the rear portion of each of said at least one intermediate penetrator segment has at least four fins.

10. A penetrator in accordance with claim 1, wherein the fins of each of said at least one intermediate penetrator segment are mounted around the circumference of the rear portion of the respective intermediate penetrator segment, each fin being pivotally mounted to the rear portion of the respective intermediate penetrator segment by at least one pivot pin, each of said at least one pivot pin being in a plane that is generally perpendicular to the longitudinal axis of said penetrator.

11. A penetrator in accordance with claim 1, wherein said penetrator has at least four penetrator segments.

12. A penetrator in accordance with claim 1, wherein said penetrator has at least eight penetrator segments.

13. A penetrator in accordance with claim 1, wherein the rear portion of each of said at least one intermediate penetrator segment has a diameter that is less than the maximum diameter of the nose portion of the respective intermediate penetrator segment, whereby when the fins of the respective intermediate penetrator segment are in their stowed positions, they do not protrude radially outwardly beyond the maximum diameter of the nose portion of the respective intermediate penetrator segment.

14. A penetrator in accordance with claim 1, wherein each of the fins of said at least one intermediate penetrator segment has a longitudinal axis, whereby when the fins of said at least one intermediate penetrator segment are in their stowed positions, the longitudinal axis of each of the fins of said at least one intermediate penetrator segment is generally parallel to the longitudinal axis of said penetrator, and when the fins of said at least one intermediate penetrator segment are in their deployed positions, the longitudinal axis of each of the thus deployed fins of said at least one intermediate penetrator segment is at an angle to the longitudinal axis of said penetrator.

15. A penetrator is accordance with claim 1, wherein said plurality of explosive elements explode substantially simultaneously.

16. A penetrator in accordance with claim 1, wherein said plurality of explosive elements explode sequentially from the rearmost positioned explosive element forward.

17. A penetrator for impacting a target, said penetrator having a leading end, a trailing end, and a longitudinal axis extending between said leading end and said trailing end, said penetrator comprising:

a plurality of penetrator segments positioned in axial alignment along the longitudinal axis of said penetrator to form a stack, said plurality of penetrator segments including a leading penetrator segment, at least one intermediate penetrator segment, and a trailing penetrator segment, each of said at least one intermediate penetrator segment and said trailing penetrator segment having a nose portion, the nose portion having a frustoconical portion and a tip portion having a smaller diameter than the minimum diameter of the frustoconical portion, and a generally cylindrical rear portion;

said leading penetrator segment being positioned at the leading end of said penetrator, the rear portion of said leading penetrator segment having a rearwardly opening cavity having a frustoconical portion and an indentation having a smaller diameter than the minimum diameter of the frustoconical portion of the rearwardly opening cavity, the rearwardly opening cavity being shaped to secureably receive a nose portion of a forwardmost one of said at least one intermediate penetrator segment such that there is a press-fit between the rearwardly opening cavity of said leading penetrator segment and the nose portion of the forwardmost one of said at least one intermediate penetrator segment;

the rear portion of each of said at least one intermediate penetrator segment having a rearwardly opening cavity therein, the rearwardly opening cavity of each of said at least one intermediate penetrator segment having a frustoconical portion and an indentation having a smaller diameter than the minimum diameter of the frustoconical portion of the rearwardly opening cavity, the rearwardly opening cavity of each of said at least one intermediate penetrator segment being shaped to secureably receive a nose portion of an immediately rearwardly positioned penetrator segment such that there is a press-fit between the rearwardly opening cavity of each of said at least one intermediate penetrator segment and the nose portion of the respective immediately rearwardly positioned penetrator segment, the nose portion of each of said at least one intermediate penetrator segment being positioned within the rearwardly opening cavity of an immediately preceding penetrator segment, each of said at least one intermediate penetrator segment having a plurality of fins pivotally mounted around the circumference of the rear portion of the respective intermediate penetrator segment, each of said fins being pivotally mounted by a pivot pin positioned through a pinhole in the fin and supported by two bosses positioned adjacent to opposing sides of the fin, said pivot pin and said pinhole being in a plane that is perpendicular to the longitudinal axis of said penetrator; each of said fins having a longitudinal axis, a stabilizing portion, and a deployment preventing arm; said stabilizing portion and said deployment preventing arm being located about the pivot pin positioned through the respective fin, each of said fins having a stowed position wherein the longitudinal axis of the respective fin is generally parallel to the longitudinal axis of said penetrator and a deployed position wherein the longitudinal axis of the thus deployed respective fin is at an angle to the longitudinal axis of said penetrator;

whereby when the nose portion of a rear penetrator segment of a pair of immediately adjacent penetrator segments is positioned within the rearwardly opening cavity of a front penetrator segment of the respective pair of immediately adjacent penetrator segments, the nose portion of the rear penetrator segment of the respective pair contacts the deployment preventing arms of the fins of the front penetrator segment of the respective pair, thereby preventing the fins of the front penetrator segment of the respective pair from pivoting from their stowed positions to their deployed positions, and whereby when the nose portion of the rear penetrator segment of the respective pair is not positioned in the rearwardly opening cavity of the front penetrator segment of the respective pair, the nose portion of the rear penetrator segment of the respective pair does not contact the deployment preventing arms of the fins of the front penetrator segment of the respective pair, thereby permitting the fins of the front penetrator segment of the respective pair to pivot from their stowed positions to their deployed positions;

said trailing penetrator segment being positioned such that said at least one intermediate penetrator segment is located between said leading penetrator segment and said trailing penetrator segment, the nose portion of said trailing penetrator segment being positioned in the rearwardly opening cavity of a rearmost one of said at least one intermediate penetrator segment, the nose portion of said trailing penetrator segment contacting the deployment preventing arms of the fins of the rearmost one of said at least one intermediate penetrator segment, thereby preventing the fins of the rearmost one of said at least one intermediate penetrator segment from pivoting from their stowed positions to their deployed positions;

a plurality of explosive elements, with at least one explosive element being positioned between each pair of adjacent penetrator segments when said plurality of penetrator segments are positioned in axial alignment with each other;

a pyrotechnic cord extending along the longitudinal axis of said penetrator and connecting said plurality of explosive elements;

whereby upon initiation of deployment of said penetrator, said plurality of penetrator segments remain in axial alignment until said pyrotechnic cord is activated, thereby initiating explosion of said plurality of explosive elements and thereby causing each pair of adjacent penetrator segments to separate from each; whereupon the fins of said at least one intermediate penetrator segment and the fins of the leading penetrator segment are allowed to pivot from their stowed positions to their deployed positions;

whereupon said plurality of penetrator segments have aerodynamically separated from each other and each penetrator segment can separately impact the target in sequence and without being adversely affected by the impact of any preceding penetrator segments.

18. A penetrator in accordance with claim 17, wherein said plurality of explosive elements explode at a time after launching of said penetrator such that each of said plurality of penetrator segments can impact the target in substantially a single location on the target.

19. A penetrator in accordance with claim 17, wherein said plurality of explosive elements explode at a time after launching of said penetrator such that aerodynamic forces can cause said plurality of penetrator segments to impact the target in multiple locations on the target.

20. A penetrator in accordance with claim 17, wherein said plurality of explosive elements explode substantially simultaneously.

21. A penetrator in accordance with claim 17, wherein said plurality of explosive elements explode sequentially from the rearmost positioned explosive element forward.

22. A penetrator for impacting a target, said penetrator having a leading end, a trailing end and a longitudinal axis extending between said leading end and said trailing end, said penetrator comprising:

a first penetrator segment positioned in axial alignment with the longitudinal axis of said penetrator, said first penetrator segment having a tail portion and a nose portion;

a second penetrator segment positioned in axial alignment with said first penetrator segment, said second penetrator segment being immediately adjacent to and preceding said first penetrator segment, said second penetrator segment having a rearwardly opening cavity shaped to secureably receive the nose portion of said first penetrator segment such that there is a press-fit between the rearwardly opening cavity of said second penetrator segment and the nose portion of said first penetrator segment, said second penetrator segment further having a plurality of fins pivotally mounted thereon, each of said fins having a stowed position and a deployed position, the nose portion of said first penetrator segment being initially positioned in the rearwardly opening cavity of said second penetrator segment such that the nose portion of said first penetrator segment engages an element associated with each of said fins of said second penetrator segment to thereby prevent the fins of said second penetrator segment from pivoting from their stowed positions to their deployed positions; and an explosive element positioned between said first and second penetrator segments;

whereby upon initiation of deployment of said penetrator, said first and second penetrator segments remain in axial alignment until said explosive element is exploded, thereby causing said first and second penetrator segments to separate from each other, whereupon the fins of said second penetrator segment pivot from their stowed positions to their deployed positions, whereupon each penetrator segment is aerodynamically stable and can separately impact the target in sequence.

23. A penetrator in accordance with claim 22, wherein each of the fins of said second penetrator segment has a stabilizing portion and a deployment preventing arm, said stabilizing portion and said deployment preventing arm positioned about a pivot; whereby when the nose portion of said first penetrator segment is positioned in the rearwardly opening cavity of said second penetrator segment, the nose portion of said first penetrator segment contacts the deployment preventing arms of the fins of said second penetrator segment, thereby preventing the fins of the second penetrator segment from pivoting from their stowed positions to their deployed positions; and whereby when the nose portion of said first penetrator segment withdraws from the rearwardly opening cavity of said second penetrator segment, the nose portion of said first penetrator segment no longer contacts the deployment preventing arms of the fins of said second penetrator segment, thereby permitting the fins of said second penetrator segment to pivot from their stowed positions to their deployed positions.

24. A penetrator in accordance with claim 22, wherein the nose portion of said first penetrator segment has a frustoconical portion and a tip portion having a smaller diameter than the minimum diameter of the frustoconical portion.

25. A penetrator in accordance with claim 24, wherein the rearwardly opening cavity of said second penetrator segment has a frustoconical portion and an indentation having a smaller diameter than the minimum diameter of the frustoconical portion, so that the frustoconical portion and indentation of the rearwardly opening cavity are complementary to the frustoconical portion and tip portion respectively of the nose portion of said first penetrator segment.

26. A penetrator in accordance with claim 22, wherein said penetrator further comprises:

a pyrotechnic cord extending along the longitudinal axis of said penetrator and connected to said explosive element;

whereby said first and second penetrator segments are secured in axial alignment with each other in a stacked configuration until said pyrotechnic cord is activated, thereby initiating explosion of said explosive element and thereby causing said first and second penetrator segments to separate from each other.

27. A penetrator in accordance with claim 22, wherein said explosive element explodes at a time after launching of said penetrator such that said first and second penetrator segments can impact the target in substantially a single location on the target.

28. A penetrator in accordance with claim 22, wherein said explosive element explodes at a time after launching of said penetrator such that aerodynamic forces can cause said first and second penetrator segments to impact the target in different locations on the target.

29. A penetrator in accordance with claim 22, wherein said second penetrator segment has at least four fins.

30. A penetrator in accordance with claim 22, wherein said second penetrator segment has a tapered nose portion and a cylindrical rear portion, with the fins of said second penetrator segment being mounted around the circumference of the rear portion of said second penetrator segment, with each fin being pivotally mounted to the second penetrator segment by at least one pivot pin, each of said at least one pivot pin being in a plane that is generally perpendicular to the longitudinal axis of said penetrator.

31. A penetrator in accordance with claim 30, wherein the rear portion of said second penetrator segment has a diameter that is less than the maximum diameter of the nose portion of said second penetrator segment, whereby when the fins of said second penetrator segment are in their stowed positions, the fins do not protrude radially outwardly beyond the maximum diameter of the nose portion of said second penetrator segment.

32. A penetrator in accordance with claim 22, wherein each of the fins of said second penetrator segment has a longitudinal axis, whereby when the fins of said second penetrator segment are in their stowed positions, the longitudinal axis of each fin of said second penetrator segment is generally parallel to the longitudinal axis of said penetrator, and when the fins of said second penetrator segment are in their deployed positions, the longitudinal axis of each the thus deployed fins of said second penetrator segment is at an angle to the longitudinal axis of said second penetrator segment.

* * * * *

UNITED STATES PATENT AND TRADEMARK OFFICE

CERTIFICATE OF CORRECTION

PATENT NO. : 6,021,716
APPLICATION NO. : 08/896432
DATED : February 8, 2000
INVENTOR(S) : Robert Joseph Taylor It is certified that error appears in the above-identified patent and that said Letters Patent is hereby corrected as shown below:

Column 2, line 61, delete “Segments””, and insert --Segments”,--.

Column 4, line 9, delete “wire,”, and insert --wire--.

Column 10, line 10 (claim 2, line 21), after “pair”, insert --, thereby permitting the fins of the front penetrator segment of the respective pair--.

Signed and Sealed this

Thirty-first Day of July, 2007

JON W. DUDAS
*Director of the United States Patent and Trademark Office*